US011482152B2

(12) United States Patent
Ahn et al.

(10) Patent No.: US 11,482,152 B2
(45) Date of Patent: Oct. 25, 2022

(54) DISPLAY SYSTEM AND METHOD OF GENERATING GAMMA VOLTAGES FOR THE SAME

(71) Applicant: Samsung Display Co., Ltd., Yongin-si (KR)

(72) Inventors: Gwangsoo Ahn, Suwon-si (KR); Keunoh Kang, Uijeongbu-si (KR); Kihyun Pyun, Gwangmyeong-si (KR); Moonshik Kang, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 229 days.

(21) Appl. No.: 16/728,756

(22) Filed: Dec. 27, 2019

(65) Prior Publication Data

US 2020/0211441 A1 Jul. 2, 2020

(30) Foreign Application Priority Data

Dec. 28, 2018 (KR) ..... 10-2018-0171541

(51) Int. Cl.
*G09G 3/20* (2006.01)

(52) U.S. Cl.
CPC ... *G09G 3/2003* (2013.01); *G09G 2320/0271* (2013.01); *G09G 2320/0673* (2013.01)

(58) Field of Classification Search
CPC ..... G09G 3/2003; G09G 2320/0271; G09G 2320/0673; G09G 3/3611
See application file for complete search history.

(56) References Cited

U.S. PATENT DOCUMENTS

2008/0291190 A1* 11/2008 Kim ..... G09G 3/3696 345/211
2011/0292096 A1* 12/2011 Ohhara ..... G09G 3/3406 345/690

(Continued)

FOREIGN PATENT DOCUMENTS

KR 10-0859520 B1 9/2008
KR 10-1961367 B1 3/2019

*Primary Examiner* — Roy P Rabindranath
(74) *Attorney, Agent, or Firm* — Lewis Roca Rothgerber Christie LLP

(57) ABSTRACT

A display system includes a source device and a sink device. The source device generates red-color display data, green-color display data, and blue-color display data and transmits first packet data including the red-color display data and a red-color display reference gamma-set, second packet data including the green-color display data and a green-color display reference gamma-set, and third packet data including the blue-color display data and a blue-color display reference gamma-set. The sink device converts the red-color display data, the green-color display data, and the blue-color display data into red-color display data-voltages, green-color display data-voltages, and blue-color display data-voltages and displays an image using the red-color display data-voltages, the green-color display data-voltages, and the blue-color display data-voltages. The sink device generates red-color display gamma-voltages, green-color display gamma-voltages, and blue-color display gamma-voltages based on the red-color display reference gamma-set, the green-color display reference gamma-set, and the blue-color display reference gamma-set, respectively.

18 Claims, 7 Drawing Sheets

(56) References Cited

U.S. PATENT DOCUMENTS

| | | | | |
|---|---|---|---|---|
| 2014/0062983 | A1* | 3/2014 | Kim | G09G 3/3696<br>345/211 |
| 2016/0343320 | A1* | 11/2016 | Tann | G09G 3/3618 |
| 2021/0020136 | A1* | 1/2021 | Zhao | G09G 3/3685 |

* cited by examiner

DISPLAY SYSTEM AND METHOD OF GENERATING GAMMA VOLTAGES FOR THE SAME

CROSS-REFERENCE TO RELATED APPLICATION

This application claims priority to and the benefit of Korean Patent Application No. 10-2018-0171541, filed on Dec. 28, 2018 in the Korean Intellectual Property Office (KIPO), the contents of which are incorporated herein in its entirety by reference.

BACKGROUND

1. Field

Example embodiments relate generally to a display system. More particularly, embodiments of the present inventive concept relate to a display system that can update gamma voltages for converting image data into data voltages and a method of generating gamma voltage for the display system.

2. Description of the Related Art

Generally, a display system includes a source device and a sink device. The source device (e.g., a graphic processing unit (GPU)) transmits image data (i.e., red color display data, green color display data, and blue color display data) for implementing an image frame to the sink device (e.g., a display device). The sink device performs a digital-analog conversion for converting the image data into data voltages (e.g., red color display data voltages, green color display data voltages, and blue color display data voltages) and displays an image corresponding to the image frame using the data voltages. The sink device generates a gamma set using a reference gamma set. Digital-analog conversion is then performed on the gamma set to generate gamma voltages for converting the image data into the data voltages. Because a conventional display system generates red color display gamma voltages, green color display gamma voltages, and blue color display gamma voltages using the same reference gamma set, luminance-characteristics of red color display pixels, luminance-characteristics of green color display pixels, and luminance-characteristics of blue color display pixels are not properly reflected. Particularly, because the conventional display system generates the red color display gamma voltages, the green color display gamma voltages, and the blue color display gamma voltages using the same reference gamma set even when performing a luminance clipping that improves blue color luminance linearity by limiting blue color maximum luminance, a red color gamma curve, a green color gamma curve, and a blue color gamma curve may be changed (or distorted) (and thus a color coordinate may also be changed (or distorted)) when a gamma curve (e.g., gamma 2.2) is tuned with respect to a white color. Similarly, a white color gamma curve may be changed (and thus the color coordinate may also be changed) when the gamma curve is tuned with respect to a red color, a green color, and/or a blue color.

SUMMARY

Some example embodiments provide for a display system in which a source device can individually control a red color display reference gamma set, a green color display reference gamma set, and a blue color display reference gamma set and a sink device can individually generate and update red color display gamma voltages, green color display gamma voltages, and blue color display gamma voltages based on the red color display reference gamma set, the green color display reference gamma set, and the blue color display reference gamma set that are received from the source device.

Some example embodiments provide a method of generating gamma voltages for the display system.

According to example embodiments, a display system may include a source device configured to generate red color display data, green color display data, and blue color display data for implementing image frames and to transmit first packet data that include the red color display data and a red color display reference gamma set, second packet data that include the green color display data and a green color display reference gamma set, and third packet data that include the blue color display data and a blue color display reference gamma set, and a sink device configured to receive the first through third packet data from the source device, to perform a digital-to-analog conversion for converting the red color display data, the green color display data, and the blue color display data into red color display data voltages, green color display data voltages, and blue color display data voltages, and to display an image corresponding to the image frame using the red color display data voltages, the green color display data voltages, and the blue color display data voltages. The sink device may include a display panel configured to display the image, a display panel driving circuit configured to drive the display panel, and a gamma voltage generating circuit configured to generate red color display gamma voltages, green color display gamma voltages, and blue color display gamma voltages for performing the digital-analog conversion based on the red color display reference gamma set, the green color display reference gamma set, and the blue color display reference gamma set, respectively.

In example embodiments, the source device may be a graphic processing unit, and the sink device may be a display device.

In example embodiments, the first through third packet data may be universal serial interface (USI) packet data.

In example embodiments, the source device may perform a luminance clipping on the blue color display reference gamma set to improve blue color luminance linearity by limiting blue color maximum luminance.

In example embodiments, the gamma voltage generating circuit may be implemented inside the display panel driving circuit.

In example embodiments, the gamma voltage generating circuit may include: a gamma register configured to sequentially and temporarily store the red color display reference gamma set, the green color display reference gamma set, and the blue color display reference gamma set; a gamma data generator configured to generate a red color display gamma set using a common reference gamma set and the red color display reference gamma set, to generate a green color display gamma set using the common reference gamma set and the green color display reference gamma set, and to generate a blue color display gamma set using the common reference gamma set and the blue color display reference gamma set; and a digital-to-analog converter configured to convert the red color display gamma set into the red color display gamma voltages, to convert the green color display gamma set into the green color display gamma voltages, and to convert the blue color display gamma set into the blue color display gamma voltages.

In example embodiments, the gamma voltage generating circuit may be configured to update the red color display gamma voltages, the green color display gamma voltages, and the blue color display gamma voltages for the image frame.

In example embodiments, the gamma voltage generating circuit may be configured to update the red color display gamma voltages, the green color display gamma voltages, and the blue color display gamma voltages when a gamma voltage update request signal is received from the source device.

In example embodiments, the gamma register comprises a memory device having a capacity capable of storing at least one of the red color display reference gamma set, the green color display reference gamma set, and the blue color display reference gamma set.

In example embodiments, the gamma voltage generating circuit may include: a first gamma register configured to store the red color display reference gamma set; a second gamma register configured to store the green color display reference gamma set; a third gamma register configured to store the blue color display reference gamma set; a gamma data generator configured to generate a red color display gamma set using a common reference gamma set and the red color display reference gamma set, to generate a green color display gamma set using the common reference gamma set and the green color display reference gamma set, and to generate a blue color display gamma set using the common reference gamma set and the blue color display reference gamma set; and a digital-to-analog converter configured to convert the red color display gamma set into the red color display gamma voltages, to convert the green color display gamma set into the green color display gamma voltages, and to convert the blue color display gamma set into the blue color display gamma voltages.

In example embodiments, the gamma voltage generating circuit may be configured to update the red color display gamma voltages, the green color display gamma voltages, and the blue color display gamma voltages for the image frame.

In example embodiments, the gamma voltage generating circuit may be configured to update the red color display gamma voltages, the green color display gamma voltages, and the blue color display gamma voltages when a gamma voltage update request signal is received from the source device.

In example embodiments, the gamma voltage generating circuit may be configured to update the red color display gamma voltages when the red color display reference gamma set of a current image frame is different from the red color display reference gamma set of a previous image frame, update the green color display gamma voltages when the green color display reference gamma set of the current image frame is different from the green color display reference gamma set of the previous image frame, and update the blue color display gamma voltages when the blue color display reference gamma set of the current image frame is different from the blue color display reference gamma set of the previous image frame.

In example embodiments, the first gamma register may include a first memory device having a capacity capable of storing the red color display reference gamma set, the second gamma register may include a second memory device having a capacity capable of storing the green color display reference gamma set, and the third gamma register may include a third memory device having a capacity capable of storing the blue color display reference gamma set.

According to example embodiments, a method of generating gamma voltages, where the gamma voltages include red color display gamma voltages, green color display gamma voltages, and blue color display gamma voltages for converting red color display data, green color display data, and blue color display data into red color display data voltages, green color display data voltages, and blue color display data voltages, respectively, to implement an image frame, may include an operation of receiving first packet data including the red color display data and a red color display reference gamma set, an operation of generating a red color display gamma set using a common reference gamma set and the red color display reference gamma set extracted from the first packet data, an operation of converting the red color display gamma set into the red color display gamma voltages, an operation of receiving second packet data including the green color display data and a green color display reference gamma set, an operation of generating a green color display gamma set using the common reference gamma set and the green color display reference gamma set extracted from the second packet data, an operation of converting the green color display gamma set into the green color display gamma voltages, an operation of receiving third packet data including the blue color display data and a blue color display reference gamma set, an operation of generating a blue color display gamma set using the common reference gamma set and the blue color display reference gamma set extracted from the third packet data, and an operation of converting the blue color display gamma set into the blue color display gamma voltages.

In example embodiments, the first through third packet data may be universal serial interface (USI) packet data.

In example embodiments, a luminance clipping may be performed on the blue color display reference gamma set to improve blue color luminance linearity by limiting blue color maximum luminance.

In example embodiments, the red color display gamma voltages, the green color display gamma voltages, and the blue color display gamma voltages may be updated for the image frame.

In example embodiments, the red color display gamma voltages, the green color display gamma voltages, and the blue color display gamma voltages may be updated when a gamma voltage update request signal is received.

In example embodiments, the red color display gamma voltages may be updated when the red color display reference gamma set of a current image frame is different from the red color display reference gamma set of a previous image frame, the green color display gamma voltages may be updated when the green color display reference gamma set of the current image frame is different from the green color display reference gamma set of the previous image frame, and the blue color display gamma voltages may be updated when the blue color display reference gamma set of the current image frame is different from the blue color display reference gamma set of the previous image frame.

A display system according to example embodiments may include a source device to generate red color display data, green color display data, and blue color display data for implementing an image frame and to transmit first packet data including the red color display data and a red color display reference gamma set, second packet data including the green color display data and a green color display reference gamma set, and third packet data including the blue color display data and a blue color display reference gamma set, and a sink device to receive the first through third packet data from the source device, to generate red color display gamma voltages, green color display gamma voltages, and blue color display gamma voltages using the red color display reference gamma set, the green color display reference gamma set, and the blue color display reference gamma set, respectively, to convert the red color display data, the green color display data, and the blue color display data into red color display data voltages, green color display data voltages, and blue color display data voltages using the red color display gamma voltages, the green color display gamma voltages, and the blue color display gamma voltages, respectively, and to display an image corresponding to the image frame using the red color display data voltages, the green color display data voltages, and the blue color display data voltages. Thus, the source device may individually control the red color display reference gamma set, the green color display reference gamma set, and the blue color display reference gamma set, and the sink device may individually generate and update the red color display gamma voltages, the green color display gamma voltages, and the blue color display gamma voltages based on the red color display reference gamma set, the green color display reference gamma set, and the blue color display reference gamma set that are received from the source device. As a result, the display system may substantially optimize (or improve) a quality of an image that is displayed by the sink device.

In addition, a method of generating gamma voltages according to example embodiments may receive first packet data including red color display data and a red color display reference gamma set, may generate a red color display gamma set using a common reference gamma set and the red color display reference gamma set extracted from the first packet data, may convert the red color display gamma set into red color display gamma voltages, may receive second packet data including green color display data and a green color display reference gamma set, may generate a green color display gamma set using the common reference gamma set and the green color display reference gamma set extracted from the second packet data, may convert the green color display gamma set into green color display gamma voltages, may receive third packet data including blue color display data and a blue color display reference gamma set, may generate a blue color display gamma set using the common reference gamma set and the blue color display reference gamma set extracted from the third packet data, and may convert the blue color display gamma set into blue color display gamma voltages. Thus, the method may individually generate and update the red color display gamma voltages, the green color display gamma voltages, and the blue color display gamma voltages based on the red color display reference gamma set, the green color display reference gamma set, and the blue color display reference gamma set that are individually controlled. As a result, the method may effectively perform a gamma tuning without a phenomenon in which a color coordinate is changed and/or a phenomenon in which a gamma curve for respective colors is changed.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
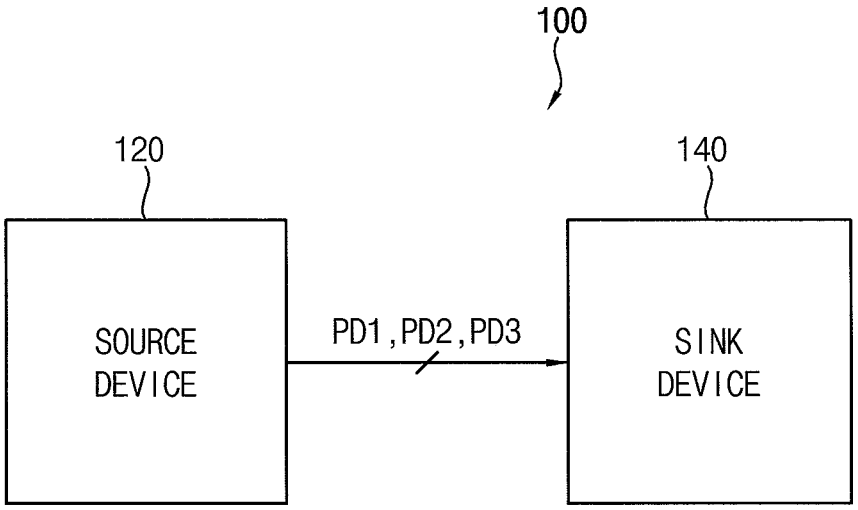
FIG. 1 is a block diagram illustrating a display system according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element is referred to as being "connected to" or "coupled to" another element, it can be directly connected to or coupled to the other element, or one or more intervening elements may be present. In addition, it will also be understood that when an element is referred to as being "between" two elements, it can be the only element between the two elements, or one or more intervening elements may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display system and/or any other relevant devices or components according to embodiments of the present invention described herein may be implemented utilizing any suitable hardware, firmware (e.g., an application-specific integrated circuit), software, or a combination of software, firmware, and hardware. For example, the display system may include a source device and a sink device. The source device may be configured to generate image data for implementing an image frame, and may be configured to transmit packet data that includes the color display data and a color display reference gamma set. The sink device may include a gamma voltage generating circuit, a display panel driving circuit, and a display panel. The gamma voltage generating circuit may include a gamma register, a gamma data generator, and a digital-analog converter. The display panel driving circuit may include a scan driver, a data driver, and a timing controller. The various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
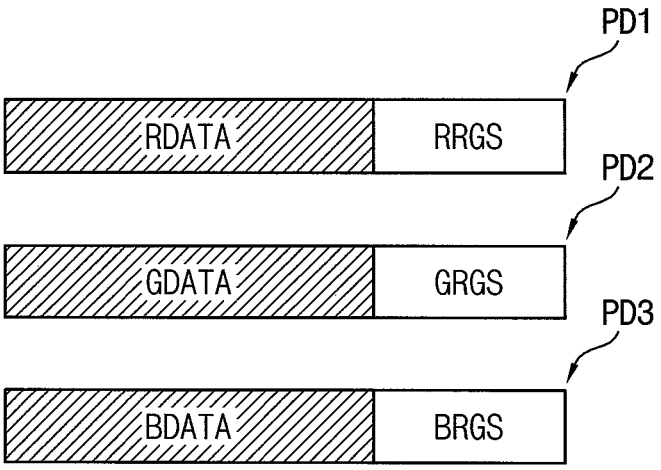
FIG. 2 is a diagram illustrating an example of first through third packet data that a source device transmits to a sink device in the display system of FIG. 1.
Figure 3:
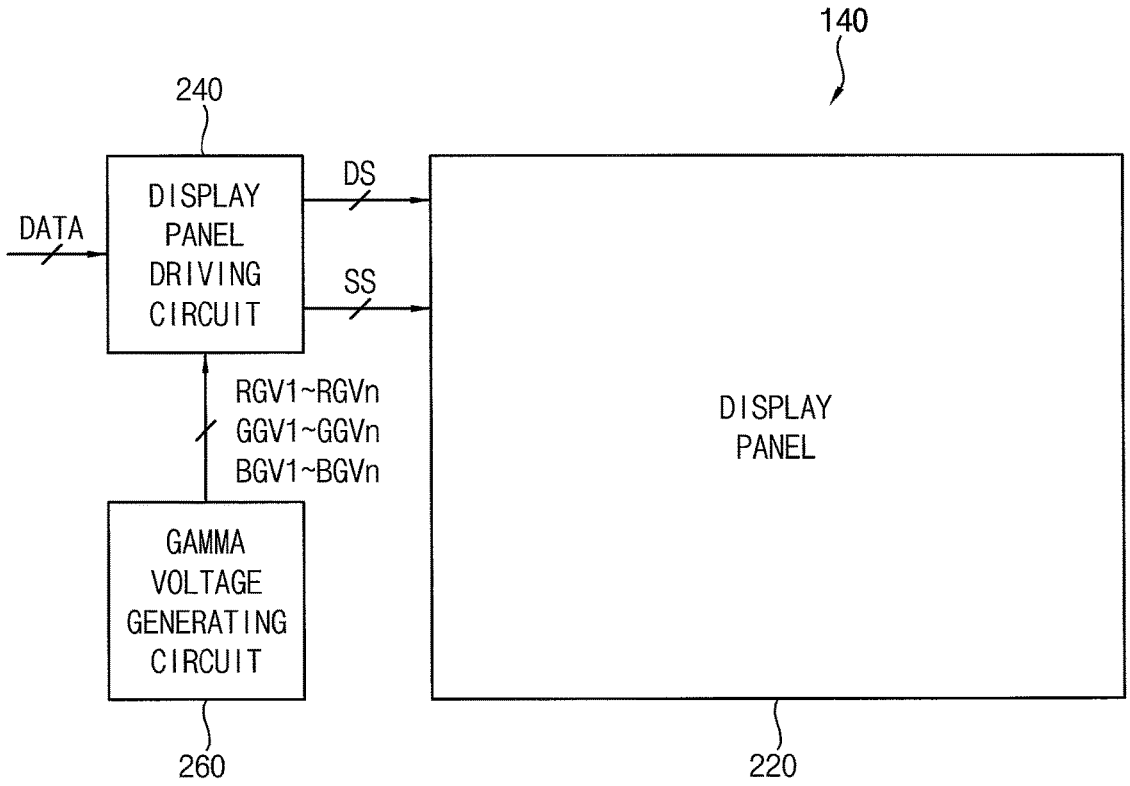
FIG. 3 is a block diagram illustrating a sink device included in the display system of FIG. 1.
Figure 4:
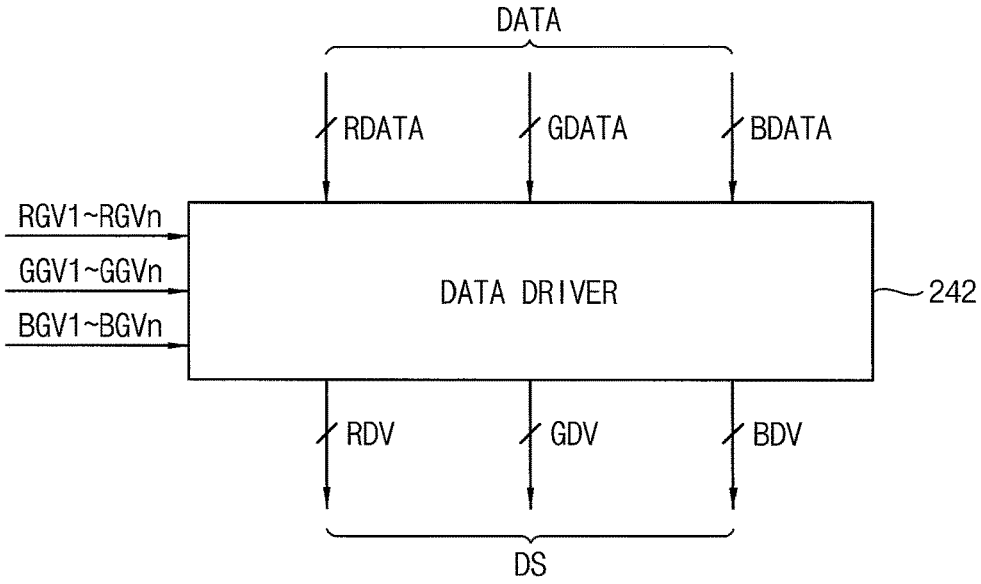
FIG. 4 is a block diagram illustrating an example in which a display panel driving circuit converts image data into data voltages in the display system of FIG. 1.

FIG. 1 is a block diagram illustrating a display system according to example embodiments. FIG. 2 is a diagram illustrating an example of first through third packet data that a source device transmits to a sink device in the display system of FIG. 1. FIG. 3 is a block diagram illustrating a sink device included in the display system of FIG. 1. FIG. 4 is a block diagram illustrating an example in which a display panel driving circuit converts image data into data voltages in the display system of FIG. 1.

Referring to FIGS. 1-4, the display system 100 may include a source device 120 and a sink device 140. Here, the source device 120 and the sink device 140 may perform data communication with each other using an interface (e.g., a specific interface). For example, the source device 120 may transmit image data RDATA, GDATA, and BDATA to the sink device 140 using a universal serial interface (USI). However, an interface between the source device 120 and the sink device 140 is not limited thereto, and any other suitable interface as would be understood by those skilled in the art may be used. In example embodiments, the source device 120 may be a graphic processing unit (GPU), and the sink device 140 may be a display device (e.g., a liquid crystal display (LCD) device, an organic light-emitting display (OLED) device, or any other suitable display device as would be understood by those skilled in the art).

The source device 120 may generate image data DATA (i.e., red color display data RDATA, green color display data GDATA, and blue color display data BDATA) for implementing an image frame, and may transmit first packet data PD1 including the red color display data RDATA and a red color display reference gamma set RRGS, second packet data PD2 including the green color display data GDATA and a green color display reference gamma set GRGS, and third packet data PD3 including the blue color display data BDATA and a blue color display reference gamma set BRGS, to the sink device 140. In an example embodiment, the first through third packet data PD1, PD2, and PD3 may be universal serial interface (e.g., USI-T) packet data. As illustrated in FIG. 2, the first packet data PD1 may have a structure in which the red color display reference gamma set RRGS is after the red color display data RDATA, the second packet data PD2 may have a structure in which the green color display reference gamma set GRGS is after the green color display data GDATA, and the third packet data PD3 may have a structure in which the blue color display reference gamma set BRGS is after the blue color display data BDATA. However, a structure of the first through third packet data PD1, PD2, and PD3 is not limited thereto. For example, the first packet data PD1 may have a structure in which the red color display reference gamma set RRGS is added before the red color display data RDATA, the second packet data PD2 may have a structure in which the green color display reference gamma set GRGS is added before the green color display data GDATA, and the third packet data PD3 may have a structure in which the blue color display reference gamma set BRGS is added before the blue color display data BDATA. In some example embodiments, each of the first through third packet data PD1, PD2, and PD3 may further include additional information (e.g., a gamma voltage update request signal or other suitable information).

As described above, the source device 120 may individually generate (or control) red color display reference gamma set RRGS, the green color display reference gamma set GRGS, and the blue color display reference gamma set BRGS. The red color display reference gamma set RRGS is used for generating red color display gamma voltages RGV1 through RGVn. The red color display gamma voltages RGV1 through RGVn are used (e.g., required) for converting the red color display data RDATA into red color display data voltages RDV to be applied to red color display pixels in the display panel 220. The green color display reference gamma set GRGS is used for generating green color display gamma voltages GGV1 through GGVn. The green color display gamma voltages GGV1 through GGVn are used for converting the green color display data GDATA into green color display data voltages GDV to be applied to green color display pixels in the display panel 220. The blue color display reference gamma set BRGS is used for generating blue color display gamma voltages BGV1 through BGVn. The blue color display gamma voltages BGV1 through BGVn are used for converting the blue color display data BDATA into blue color display data voltages BDV to be applied to blue color display pixels in the display panel 220. The source device 120 may allow the red color display reference gamma set RRGS, the green color display reference gamma set GRGS, and the blue color display reference gamma set BRGS to be included in the first packet data PD1, the second packet data PD2, and the third packet data PD3, respectively. Thus, the display system 100 may prevent or reduce gamma curve distortion and/or color coordinate distortion occurring in a conventional display system that generates the red color display gamma voltages RGV1 through RGVn, the green color display gamma voltages GGV1 through GGVn, and the blue color display gamma voltages BGV1 through BGVn using the same reference gamma set.

In an example embodiment, the source device 120 may perform a luminance clipping on the blue color display reference gamma set BRGS included in the third packet data PD3 to improve blue color luminance linearity by limiting blue color maximum luminance. For example, the display system 100 has characteristics in which when blue color luminance sharply rises in a grayscale range (e.g., in a specific grayscale range such as a high-grayscale range) (i.e., the blue color luminance linearity is bad), the source device 120 may perform the luminance clipping to improve the blue color luminance linearity by limiting the blue color maximum luminance to be under a luminance (e.g., a specific luminance) in an entire grayscale range. That is, because the source device 120 is capable of individually controlling the red color display reference gamma set RRGS, the green color display reference gamma set GRGS, and the blue color display reference gamma set BRGS, the source device 120 may perform the luminance clipping on the blue color display reference gamma set BRGS without concurrently performing the luminance clipping on the red color display reference gamma set RRGS and the green color display reference gamma set GRGS.

The sink device 140 may receive the first through third packet data PD1, PD2, and PD3 from the source device 120, may perform a digital-analog conversion for converting the red color display data RDATA included in the first packet data PD1, the green color display data GDATA included in the second packet data PD2, and the blue color display data BDATA included in the third packet data PD3, into the red color display data voltages RDV, the green color display data voltages GDV, and the blue color display data voltages BDV, and may display an image corresponding to the image frame using the red color display data voltages RDV, the green color display data voltages GDV, and the blue color display data voltages BDV (i.e., by applying the red color display data voltages RDV to the red color display pixels, by applying the green color display data voltages GDV to the green color display pixels, and by applying the blue color display data voltages BDV to the blue color display pixels). For example, the sink device 140 may generate the red color display gamma voltages RGV1 through RGVn using the red color display reference gamma set RRGS included in the first packet data PD1, may generate the green color display gamma voltages GGV1 through GGVn using the green color display reference gamma set GRGS included in the second packet data PD2, and may generate the blue color display gamma voltages BGV1 through BGVn using the blue color display reference gamma set BRGS included in the third packet data PD3. As described above, the red color display gamma voltages RGV1 through RGVn may be used to convert the red color display data RDATA included in the first packet data PD1 into the red color display data voltages RDV, the green color display gamma voltages GGV1 through GGVn may be used to convert the green color display data GDATA included in the second packet data PD2 into the green color display data voltages GDV, and the blue color display gamma voltages BGV1 through BGVn may be used to convert the blue color display data BDATA included in the third packet data PD3 into the blue color display data voltages BDV.

In an example embodiment, as illustrated in FIG. 3, the sink device 140 may include a display panel 220, a display panel driving circuit 240, and a gamma voltage generating circuit 260. The display panel 220 may display an image corresponding to the image frame. The display panel 220 may include a plurality of pixels (i.e., the red color display pixels, the green color display pixels, and the blue color display pixels). The pixels may be arranged in various suitable manners (e.g., a matrix manner or any other suitable arrangement) in the display panel 220. The display panel driving circuit 240 may drive the display panel 220. For this operation, the display panel driving circuit 240 may include a scan driver, a data driver 242, a timing controller, and/or any other suitable circuits as would be understood by those skilled in the art. The display panel 220 may be connected to the data driver 242 via a plurality of data-lines. The display panel 220 may be connected to the scan driver via a plurality of scan-lines. For example, the scan driver may provide a scan signal SS to the display panel 220 via the scan-lines. The data driver 242 may provide a data signal DS to the display panel 220 via the data-lines. That is, as illustrated in FIG. 4, the data driver 242 may receive the red color display gamma voltages RGV1 through RGVn, the green color display gamma voltages GGV1 through GGVn, and the blue color display gamma voltages BGV1 through BGVn from the gamma voltage generating circuit 260. In addition, the data driver 242 may receive the image data (i.e., the red color display data RDATA, the green color display data GDATA, and the blue color display data BDATA) from the timing controller. Thus, the data driver 242 may convert the red color display data RDATA into the red color display data voltages RDV based on the red color display gamma voltages RGV1 through RGVn, may convert the green color display data GDATA into the green color display data voltages GDV based on the green color display gamma voltages GGV1 through GGVn, may convert the blue color display data BDATA into the blue color display data voltages BDV based on the blue color display gamma voltages BGV1 through BGVn, and may provide the data signal DS (i.e., the red color display data voltages RDV, the green color display data voltages GDV, and the blue color display data voltages BDV) to the display panel 220. As a result, the image corresponding to the image frame may be displayed on the display panel 220 by applying the red color display data voltages RDV to the red color display pixels, by applying the green color display data voltages GDV to the green color display pixels, and by applying the blue color display data voltages BDV to the blue color display pixels. The timing controller may control the scan driver, the data driver 242, and any other suitable drivers or circuits as would be understood by those skilled in the art. In some example embodiments, the timing controller may perform processing (e.g., a specific processing) on the image data (e.g., deterioration compensation or any other suitable image processing as would be understood by those skilled in the art). Although it is illustrated in FIG. 3 that the gamma voltage generating circuit 260 is separated from the display panel driving circuit 240, in some example embodiments, the gamma voltage generating circuit 260 may be integrated into (e.g., implemented inside) the display panel driving circuit 240.

In some example embodiments, the display system 100 may include the source device 120 that generates the red color display data RDATA, the green color display data GDATA, and the blue color display data BDATA for implementing the image frame. The source device 120 also transmits the first packet data PD1 including the red color display data RDATA and the red color display reference gamma set RRGS, the second packet data PD2 including the green color display data GDATA and the green color display reference gamma set GRGS, and the third packet data PD3 including the blue color display data BDATA and the blue color display reference gamma set BRGS. The sink device 140 receives the first through third packet data PD1, PD2, and PD3 from the source device 120, and generates the red color display gamma voltages RGV1 through RGVn, the green color display gamma voltages GGV1 through GGVn, and the blue color display gamma voltages BGV1 through BGVn using the red color display reference gamma set RRGS, the green color display reference gamma set GRGS, and the blue color display reference gamma set BRGS, respectively. The sink device 140 then converts the red color display data RDATA, the green color display data GDATA, and the blue color display data BDATA into the red color display data voltages RDV, the green color display data voltages GDV, and the blue color display data voltages BDV using the red color display gamma voltages RGV1 through RGVn, the green color display gamma voltages GGV1 through GGVn, and the blue color display gamma voltages BGV1 through BGVn, respectively, and displays the image corresponding to the image frame using the red color display data voltages RDV, the green color display data voltages GDV, and the blue color display data voltages BDV. Thus, the source device 120 may individually control the red color display reference gamma set RRGS, the green color display reference gamma set GRGS, and the blue color display reference gamma set BRGS. The sink device 140 may individually generate and update the red color display gamma voltages RGV1 through RGVn, the green color display gamma voltages GGV1 through GGVn, and the blue color display gamma voltages BGV1 through BGVn based on the red color display reference gamma set RRGS, the green color display reference gamma set GRGS, and the blue color display reference gamma set BRGS that are received from the source device 120. As a result, the display system 100 may substantially optimize (or improve) a quality of the image that is displayed by the sink device 140. Although it is illustrated in FIG. 3 that the sink device 140 includes the display panel 220, the display panel driving circuit 240, and the gamma voltage generating circuit 260, it should be understood that the sink device 140 may further include other components.

Figure 5:
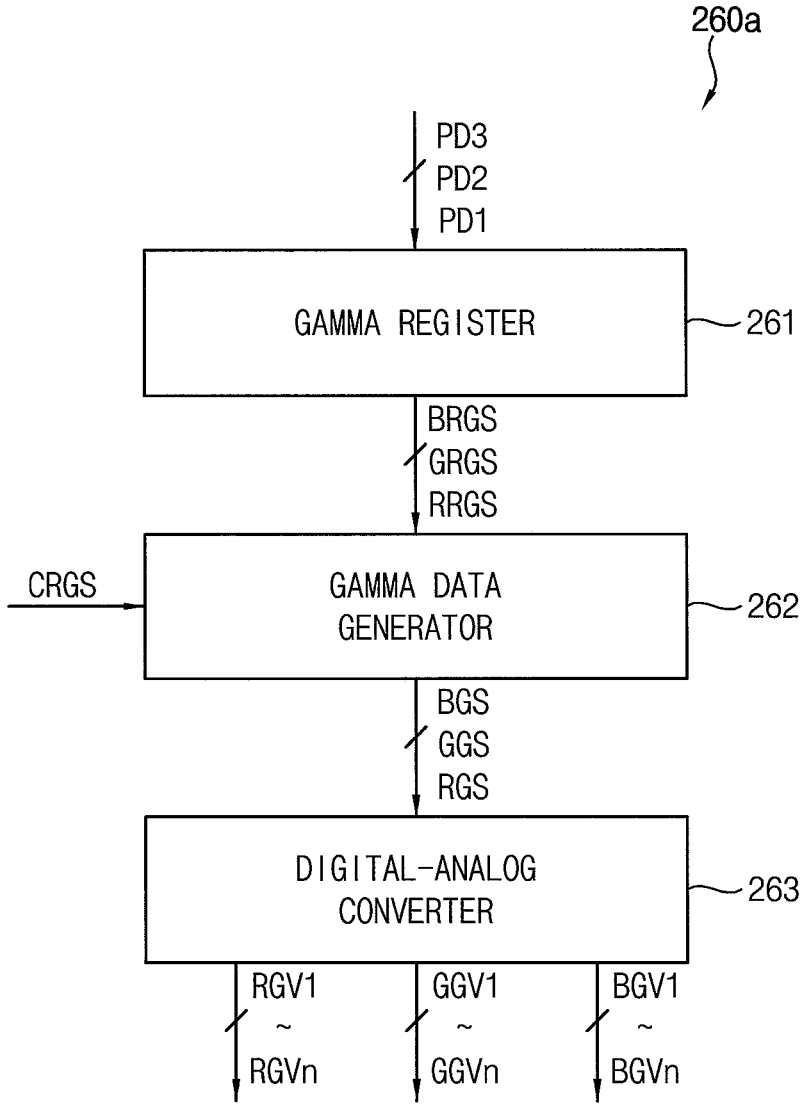
FIG. 5 is a block diagram illustrating an example of a gamma voltage generating circuit of a sink device included in the display system of FIG. 1.

FIG. 5 is a block diagram illustrating an example of a gamma voltage generating circuit of a sink device included in the display system of FIG. 1.

Referring to FIG. 5, the gamma voltage generating circuit 260*a* may include a gamma register 261, a gamma data generator 262, and a digital-analog converter 263.

The gamma register 261 may sequentially and temporarily store the red color display reference gamma set RRGS included in the first packet data PD1, the green color display reference gamma set GRGS included in the second packet data PD2, and the blue color display reference gamma set BRGS included in the third packet data PD3. In an example embodiment, the gamma register 261 may be implemented by a memory device having a capacity capable of storing at least one selected from the red color display reference gamma set RRGS included in the first packet data PD1, the green color display reference gamma set GRGS included in the second packet data PD2, and the blue color display reference gamma set BRGS included in the third packet data PD3. For example, when the gamma register 261 is implemented by the memory device having the capacity capable of storing at least one selected from the red color display reference gamma set RRGS included in the first packet data PD1, the green color display reference gamma set GRGS included in the second packet data PD2, and the blue color display reference gamma set BRGS included in the third packet data PD3 and when the first packet data PD1, the second packet data PD2, and the third packet data PD3 are sequentially transmitted from the source device 120 to the sink device 140, the gamma register 261 may store the red color display reference gamma set RRGS included in the first packet data PD1 in response to receiving the first packet data PD1, may store (e.g., overwrite the red color display reference gamma set RRGS included in the first packet data PD1) the green color display reference gamma set GRGS included in the second packet data PD2 in response to receiving the second packet data PD2, and then may store (e.g., overwrite the green color display reference gamma set GRGS included in the second packet data PD2) the blue color display reference gamma set BRGS included in the third packet data PD3 in response to receiving the third packet data PD3.

The gamma data generator 262 may generate a red color display gamma set RGS using a common reference gamma set CRGS and the red color display reference gamma set RRGS included in the first packet data PD1, may generate a green color display gamma set GGS using the common reference gamma set CRGS and the green color display reference gamma set GRGS included in the second packet data PD2, and may generate a blue color display gamma set BGS using the common reference gamma set CRGS and the blue color display reference gamma set BRGS included in the third packet data PD3. The common reference gamma set CRGS may include gamma values in a digital form (i.e., digital gamma values) corresponding to some grayscales (e.g., grayscale values), and the digital gamma values may be commonly used to generate the red color display gamma set RGS, the green color display gamma set GGS, and the blue color display gamma set BGS. On the other hand, the red color display reference gamma set RRGS may include digital gamma values corresponding to some grayscales (e.g., grayscale values), and the digital gamma values may be used to generate the red color display gamma set RGS. In addition, the green color display reference gamma set GRGS may include digital gamma values corresponding to some grayscales (e.g., grayscale values), and the digital gamma values may be used to generate the green color display gamma set GGS. Further, the blue color display reference gamma set BRGS may include digital gamma values corresponding to some grayscales (e.g., grayscale values), and the digital gamma values may be used to generate the blue color display gamma set BGS. Thus, the gamma data generator 262 may generate the red color display gamma set RGS including digital gamma values corresponding to all grayscales (e.g., grayscale values) based on the common reference gamma set CRGS and the red color display reference gamma set RRGS, may generate the green color display gamma set GGS including digital gamma values corresponding to all grayscales (e.g., grayscale values) based on the common reference gamma set CRGS and the green color display reference gamma set GRGS, and may generate the blue color display gamma set BGS including digital gamma values corresponding to all grayscales (e.g., grayscale values) based on the common reference gamma set CRGS and the blue color display reference gamma set BRGS.

The digital-analog converter 263 may convert the red color display gamma set RGS into the red color display gamma voltages RGV1 through RGVn, may convert the green color display gamma set GGS into the green color display gamma voltages GGV1 through GGVn, and may convert the blue color display gamma set BGS into the blue color display gamma voltages BGV1 through BGVn. For example, when the red color display gamma set RGS includes first through (n)th red color display gamma values in a digital form corresponding to all grayscales, when the green color display gamma set GGS includes first through (n)th green color display gamma values in a digital form corresponding to all grayscales, and when the blue color display gamma set BGS includes first through (n)th blue color display gamma values in a digital form corresponding to all grayscales, the digital-analog converter 263 may convert the first through (n)th red color display gamma values included in the red color display gamma set RGS into the first through (n)th red color display gamma voltages RGV1 through RGVn, may convert the first through (n)th green color display gamma values included in the green color display gamma set GGS into the first through (n)th green color display gamma voltages GGV1 through GGVn, and may convert the first through (n)th blue color display gamma values included in the blue color display gamma set BGS into the first through (n)th blue color display gamma voltages BGV1 through BGVn. In an example embodiment, the gamma voltage generating circuit 260*a* may update the red color display gamma voltages RGV1 through RGVn, the green color display gamma voltages GGV1 through GGVn, and the blue color display gamma voltages BGV1 through BGVn for each image frame. In another example embodiment, the gamma voltage generating circuit 260*a* may update the red color display gamma voltages RGV1 through RGVn, the green color display gamma voltages GGV1 through GGVn, and the blue color display gamma voltages BGV1 through BGVn when a gamma voltage update request signal is received from the source device 120. In this case, the gamma voltage generating circuit 260*a* may update the red color display gamma voltages RGV1 through RGVn, the green color display gamma voltages GGV1 through GGVn, and the blue color display gamma voltages BGV1 through BGVn when it is determined that a gamma voltage update is necessary, but may not update the red color display gamma voltages RGV1 through RGVn, the green color display gamma voltages GGV1 through GGVn, and the blue color display gamma voltages BGV1 through BGVn when it is determined that updating the gamma voltages is not necessary. In other words, the red color display gamma voltages RGV1 through RGVn, the green color display gamma voltages GGV1 through GGVn, and the blue color display gamma voltages BGV1 through BGVn may be reused when it is determined that the gamma voltage update is not necessary.

Figure 6:
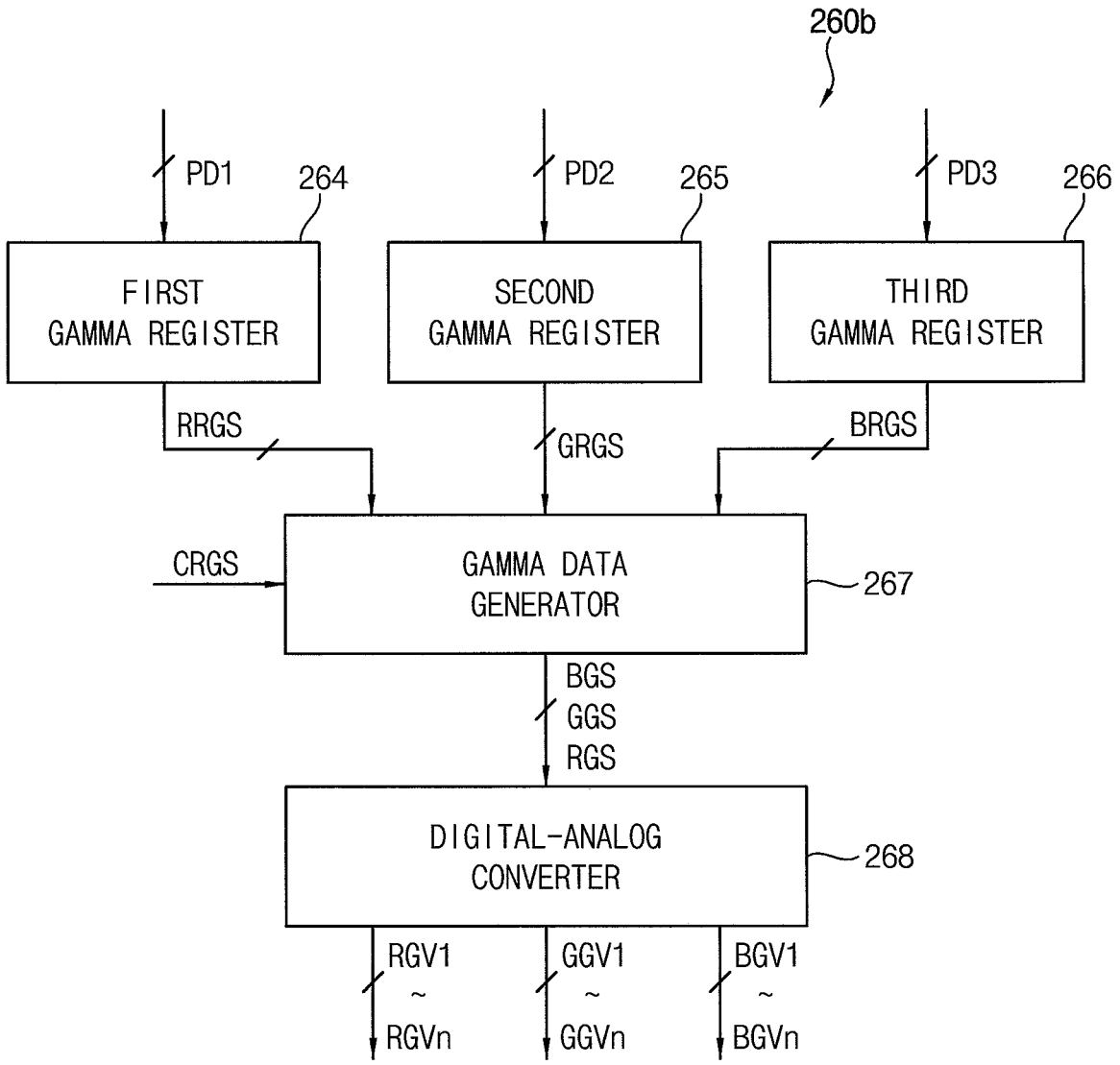
FIG. 6 is a block diagram illustrating another example of a gamma voltage generating circuit of a sink device included in the display system of FIG. 1.

FIG. 6 is a block diagram illustrating another example of a gamma voltage generating circuit of a sink device included in the display system of FIG. 1.

Referring to FIG. 6, the gamma voltage generating circuit 260*b* may include a first gamma register 264, a second gamma register 265, a third gamma register 266, a gamma data generator 267, and a digital-to-analog converter 268.

The first gamma register 264 may store the red color display reference gamma set RRGS included in the first packet data PD1. The second gamma register 265 may store the green color display reference gamma set GRGS included in the second packet data PD2. The third gamma register 266 may store the blue color display reference gamma set BRGS included in the third packet data PD3. In an example embodiment, the first gamma register 264 may be implemented by a first memory device having a capacity capable of storing the red color display reference gamma set RRGS included in the first packet data PD1, the second gamma register 265 may be implemented by a second memory device having a capacity capable of storing the green color display reference gamma set GRGS included in the second packet data PD2, and the third gamma register 266 may be implemented by a third memory device having a capacity capable of storing the blue color display reference gamma set BRGS included in the third packet data PD3. For example, when the first packet data PD1, the second packet data PD2, and the third packet data PD3 are transmitted (e.g., sequentially transmitted) from the source device 120 to the sink device 140, the first gamma register 264 may store the red color display reference gamma set RRGS included in the first packet data PD1 in response to receiving the first packet data PD1, the second gamma register 265 may store the green color display reference gamma set GRGS included in the second packet data PD2 in response to receiving the second packet data PD2, and the third gamma register 266 may store the blue color display reference gamma set BRGS included in the third packet data PD3 in response to receiving the third packet data PD3.

The gamma data generator 267 may generate a red color display gamma set RGS using a common reference gamma set CRGS and the red color display reference gamma set RRGS included in the first packet data PD1, may generate a green color display gamma set GGS using the common reference gamma set CRGS and the green color display reference gamma set GRGS included in the second packet data PD2, and may generate a blue color display gamma set BGS using the common reference gamma set CRGS and the blue color display reference gamma set BRGS included in the third packet data PD3. The common reference gamma set CRGS may include gamma values in a digital form (i.e., digital gamma values) corresponding to some grayscales (e.g., grayscale values), and the digital gamma values may be commonly used to generate the red color display gamma set RGS, the green color display gamma set GGS, and the blue color display gamma set BGS. In other embodiments, the red color display reference gamma set RRGS may include digital gamma values corresponding to some grayscales (e.g., grayscale values), and the digital gamma values may be used to generate the red color display gamma set RGS. In addition, the green color display reference gamma set GRGS may include digital gamma values corresponding to some grayscales (e.g., grayscale values), and the digital gamma values may be used to generate the green color display gamma set GGS. Further, the blue color display reference gamma set BRGS may include digital gamma values corresponding to some grayscales (e.g., grayscale values), and the digital gamma values may be used to generate the blue color display gamma set BGS. Thus, the gamma data generator 267 may generate the red color display gamma set RGS including digital gamma values corresponding to all grayscales (e.g., grayscale values) based on the common reference gamma set CRGS and the red color display reference gamma set RRGS, may generate the green color display gamma set GGS including digital gamma values corresponding to all grayscales (e.g., grayscale values) based on the common reference gamma set CRGS and the green color display reference gamma set GRGS, and may generate the blue color display gamma set BGS including digital gamma values corresponding to all grayscales (e.g., grayscale values) based on the common reference gamma set CRGS and the blue color display reference gamma set BRGS.

The digital-to-analog converter 268 may convert the red color display gamma set RGS into the red color display gamma voltages RGV1 through RGVn, may convert the green color display gamma set GGS into the green color display gamma voltages GGV1 through GGVn, and may convert the blue color display gamma set BGS into the blue color display gamma voltages BGV1 through BGVn. For example, when the red color display gamma set RGS includes first through (n)th red color display gamma values in a digital form corresponding to all grayscales (e.g., grayscale values), when the green color display gamma set GGS includes first through (n)th green color display gamma values in a digital form corresponding to all grayscales (e.g., grayscale values), and when the blue color display gamma set BGS includes first through (n)th blue color display gamma values in a digital form corresponding to all grayscales (e.g., grayscale values), the digital-to-analog converter 268 may convert the first through (n)th red color display gamma values included in the red color display gamma set RGS into the first through (n)th red color display gamma voltages RGV1 through RGVn, may convert the first through (n)th green color display gamma values included in the green color display gamma set GGS into the first through (n)th green color display gamma voltages GGV1 through GGVn, and may convert the first through (n)th blue color display gamma values included in the blue color display gamma set BGS into the first through (n)th blue color display gamma voltages BGV1 through BGVn. In an example embodiment, the gamma voltage generating circuit 260*b* may update the red color display gamma voltages RGV1 through RGVn, the green color display gamma voltages GGV1 through GGVn, and the blue color display gamma voltages BGV1 through BGVn for each image frame. In another example embodiment, the gamma voltage generating circuit 260*b* may update the red color display gamma voltages RGV1 through RGVn, the green color display gamma voltages GGV1 through GGVn, and the blue color display gamma voltages BGV1 through BGVn when a gamma voltage update request signal is received from the source device 120 (e.g., when a gamma voltage update request signal is received). In still another example embodiment, the gamma voltage generating circuit 260*b* may update the red color display gamma voltages RGV1 through RGVn when the red color display reference gamma set RRGS of a current image frame is different from the red color display reference gamma set RRGS of a previous image frame, may update the green color display gamma voltages GGV1 through GGVn when the green color display reference gamma set GRGS of the current image frame is different from the green color display reference gamma set GRGS of the previous image frame, and may update the blue color display gamma voltages BGV1 through BGVn when the blue color display reference gamma set BRGS of the current image frame is different from the blue color display reference gamma set BRGS of the previous image frame. In this case, the gamma voltage generating circuit 260*b* may update the red color display gamma voltages RGV1 through RGVn, the green color display gamma voltages GGV1 through GGVn, and the blue color display gamma voltages BGV1 through BGVn when a gamma voltage update is necessary as the reference gamma set has been changed between the previous image frame and the current image frame. On the other hand, the gamma voltage generating circuit 260*b* may not update the red color display gamma voltages RGV1 through RGVn, the green color display gamma voltages GGV1 through GGVn, and the blue color display gamma voltages BGV1 through BGVn when the gamma voltage update is not necessary as the reference gamma set has not been changed between the previous image frame and the current image frame.

Figure 7:
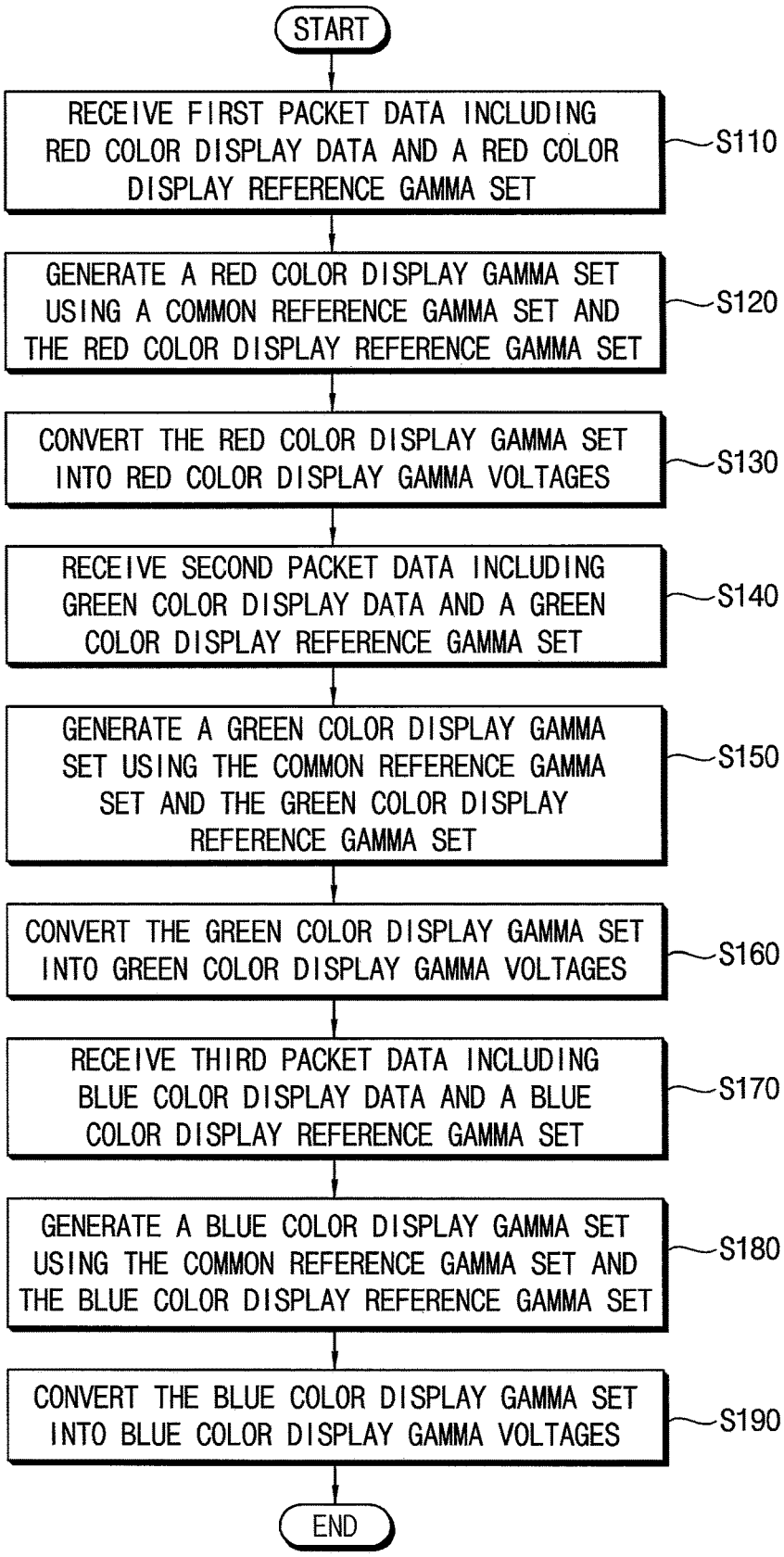
FIG. 7 is a flowchart illustrating a method of generating gamma voltages according to example embodiments.

FIG. 7 is a flowchart illustrating a method of generating gamma voltages according to example embodiments.

Referring to FIG. 7, the method of FIG. 7 may generate red color display gamma voltages, green color display gamma voltages, and blue color display gamma voltages for converting red color display data, green color display data, and blue color display data into red color display data voltages, green color display data voltages, and blue color display data voltages, respectively, to implement an image frame. Specifically, the method of FIG. 7 may receive first packet data including the red color display data and a red color display reference gamma set (S110), may generate a red color display gamma set using a common reference gamma set and the red color display reference gamma set extracted from the first packet data (S120), and may convert the red color display gamma set into the red color display gamma voltages (S130). According to example embodiments, the first packet data may be universal serial interface packet data, the red color display reference gamma set may include gamma values in a digital form (i.e., digital gamma values) corresponding to some grayscales (e.g., grayscale values), and the digital gamma values may be used to generate the red color display gamma set. Subsequently, the method of FIG. 7 may receive second packet data including the green color display data and a green color display reference gamma set (S140), may generate a green color display gamma set using the common reference gamma set and the green color display reference gamma set extracted from the second packet data (S150), and may convert the green color display gamma set into the green color display gamma voltages (S160). Here, the second packet data may be universal serial interface packet data, the green color display reference gamma set may include digital gamma values corresponding to some grayscales (e.g., grayscale values), and the digital gamma values may be used to generate the green color display gamma set. Next, the method of FIG. 7 may receive third packet data including the blue color display data and a blue color display reference gamma set (S170), may generate a blue color display gamma set using the common reference gamma set and the blue color display reference gamma set extracted from the third packet data (S180), and may convert the blue color display gamma set into the blue color display gamma voltages (S190). Here, the third packet data may be universal serial interface packet data, the blue color display reference gamma set may include digital gamma values corresponding to some grayscales (e.g., grayscale values), and the digital gamma values may be used to generate the blue color display gamma set. In example embodiments, the common reference gamma set may include digital gamma values corresponding to some grayscales (e.g., grayscale values), and the digital gamma values may be commonly used to generate the red color display gamma set, the green color display gamma set, and the blue color display gamma set. In an example embodiment, a luminance clipping is performed on the blue color display reference gamma set included in the third packet data to improve blue color luminance linearity by limiting blue color maximum luminance.

In brief, the method of FIG. 7 may receive the first packet data including the red color display data and the red color display reference gamma set (S110), may generate the red color display gamma set using the common reference gamma set and the red color display reference gamma set extracted from the first packet data (S120), may convert the red color display gamma set into the red color display gamma voltages (S130), may receive the second packet data including the green color display data and the green color display reference gamma set (S140), may generate the green color display gamma set using the common reference gamma set and the green color display reference gamma set extracted from the second packet data (S150), may convert the green color display gamma set into the green color display gamma voltages (S160), may receive the third packet data including the blue color display data and the blue color display reference gamma set (S170), may generate the blue color display gamma set using the common reference gamma set and the blue color display reference gamma set extracted from the third packet data (S180), and may convert the blue color display gamma set into the blue color display gamma voltages (S190). Thus, the method of FIG. 7 may generate (e.g., individually generate) and update (e.g., individually update) the red color display gamma voltages, the green color display gamma voltages, and the blue color display gamma voltages based on the red color display reference gamma set, the green color display reference gamma set, and the blue color display reference gamma set that are individually controlled. As a result, the method of FIG. 7 may effectively perform a gamma tuning without a phenomenon in which a color coordinate is changed and/or a phenomenon in which a gamma curve for respective colors is changed. Although it is described above that the first packet data, the second packet data, and the third packet data are received in the order listed and thus the red color display gamma voltages, the green color display gamma voltages, and the blue color display gamma voltages are generated in the order listed, an order of receiving the first packet data, the second packet data, and the third packet data and an order of generating the red color display gamma voltages, the green color display gamma voltages, and the blue color display gamma voltages are not limited thereto. In an example embodiment, the method of FIG. 7 may update the red color display gamma voltages, the green color display gamma voltages, and the blue color display gamma voltages for each image frame. In another example embodiment, the method of FIG. 7 may update the red color display gamma voltages, the green color display gamma voltages, and the blue color display gamma voltages when a gamma voltage update request signal is received. In still another example embodiment, the method of FIG. 7 may update the red color display gamma voltages when the red color display reference gamma set of a current image frame is different from the red color display reference gamma set of a previous image frame, may update the green color display gamma voltages when the green color display reference gamma set of the current image frame is different from the green color display reference gamma set of the previous image frame, and may update the blue color display gamma voltages when the blue color display reference gamma set of the current image frame is different from the blue color display reference gamma set of the previous image frame. Because these are described above, duplicated description related thereto may not be repeated.

Figure 8:
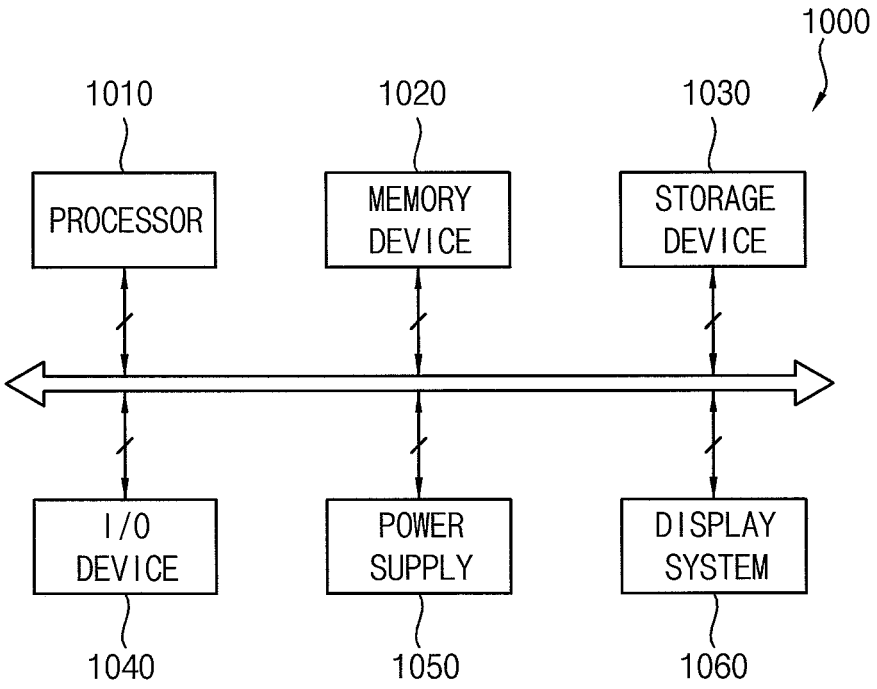
FIG. 8 is a block diagram illustrating an electronic device according to example embodiments.
Figure 9:
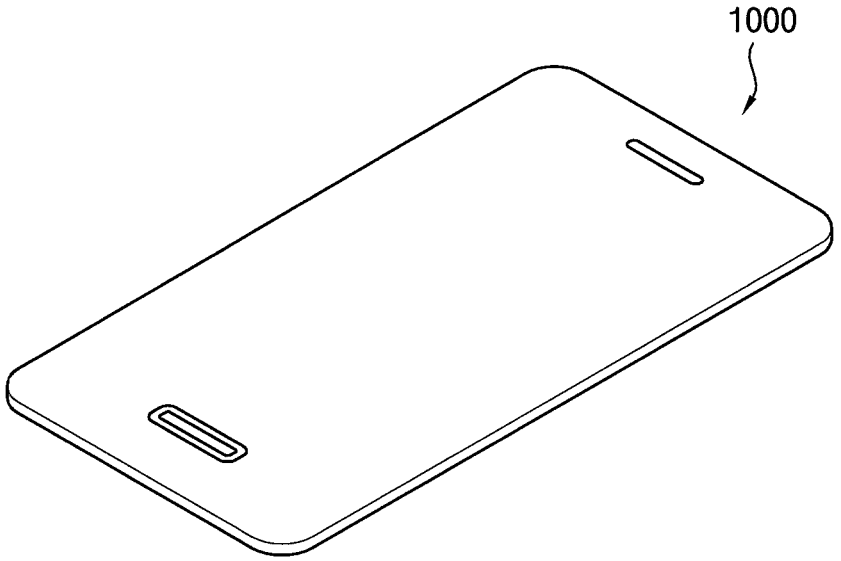
FIG. 9 is a diagram illustrating an example in which the electronic device of FIG. 8 is implemented as a smart phone.
Figure 10:
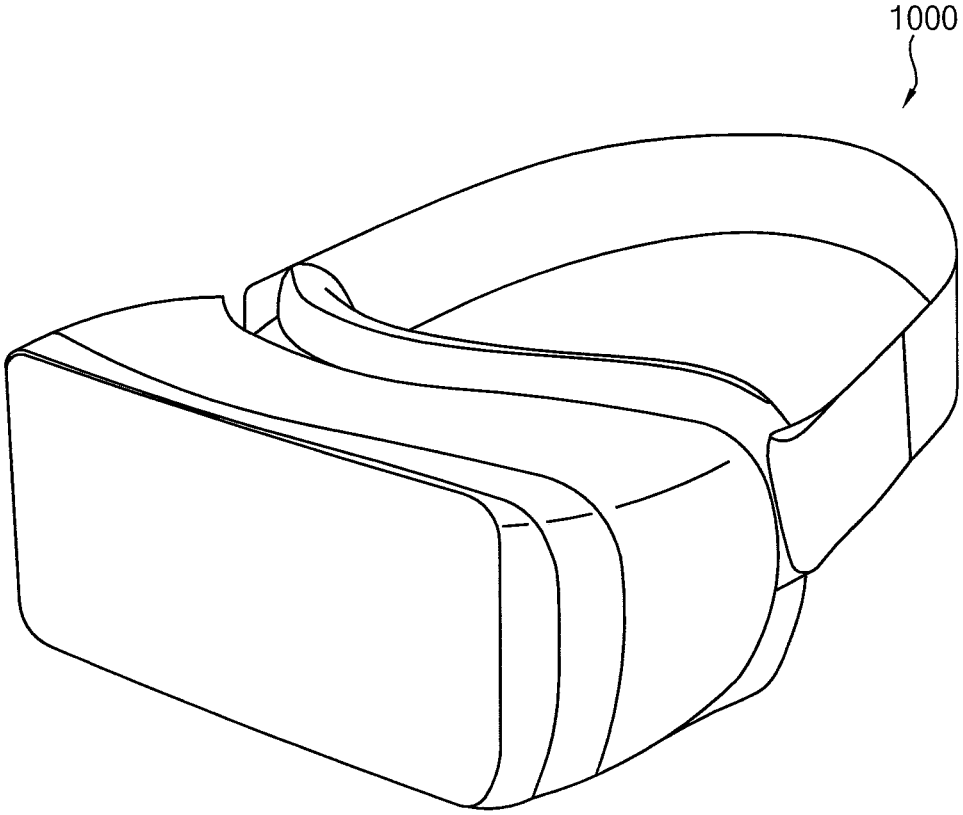
FIG. 10 is a diagram illustrating an example in which the electronic device of FIG. 8 is implemented as a head mounted display (HMD) device.

FIG. 8 is a block diagram illustrating an electronic device according to example embodiments, FIG. 9 is a diagram illustrating an example in which the electronic device of FIG. 8 is implemented as a smart phone, and FIG. 10 is a diagram illustrating an example in which the electronic device of FIG. 8 is implemented as a head mounted display (HMD) device.

Referring to FIGS. 8-10, the electronic device 1000 may include a processor 1010, a memory device 1020, a storage device 1030, an input/output (I/O) device 1040, a power supply 1050, and a display system 1060. Here, the display system 1060 may be the display system 100 of FIG. 1. In addition, the electronic device 1000 may further include a plurality of ports for communicating with a video card, a sound card, a memory card, a universal serial bus (USB) device, and/or any other suitable electronic devices as would be understood by those skilled in the art. In an example embodiment, as illustrated in FIG. 9, the electronic device 1000 may be implemented as a smart phone. In another example embodiment, as illustrated in FIG. 10, the electronic device 1000 may be implemented as a head mounted display device. However, the electronic device 1000 is not limited thereto. For example, the electronic device 1000 may be implemented as a cellular phone, a video phone, a smart pad, a smart watch, a tablet PC, a car navigation system, a television, a computer monitor, a laptop, or any other suitable electronic device as would be understood by those skilled in the art.

The processor 1010 may perform various computing functions. The processor 1010 may be a microprocessor, a central processing unit (CPU), an application processor (AP), or any other suitable processing circuit. The processor 1010 may be coupled to other components via an address bus, a control bus, a data bus, or any other suitable bus. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM)

device, a nano floating gate memory (NFGM) device, a polymer random access memory (PoRAM) device, a magnetic random access memory (MRAM) device, a ferroelectric random access memory (FRAM) device, or any other suitable non-volatile memory and/or at least one volatile memory device such as a dynamic random access memory (DRAM) device, a static random access memory (SRAM) device, a mobile DRAM device, or any other suitable volatile memory device. The storage device 1030 may include a solid state drive (SSD) device, a hard disk drive (HDD) device, a CD-ROM device, or any other suitable device for storing data as would be understood by those skilled in the art. The I/O device 1040 may include an input device such as a keyboard, a keypad, a mouse device, a touch-pad, a touch-screen, or any other suitable input device, and an output device such as a printer, a speaker, or any other suitable output device. In some example embodiments, the I/O device 1040 may include the display system 1060. The power supply 1050 may provide power for operations of the electronic device 1000.

The display system 1060 may be coupled to other components via the buses or other communication links. For example, the display system 1060 may include a source device and a sink device that perform data communication with each other using an interface (e.g., a specific interface such as a universal serial interface). The source device may generate red color display data, green color display data, and blue color display data for implementing an image frame and may transmit first packet data including the red color display data and a red color display reference gamma set, second packet data including the green color display data and a green color display reference gamma set, and third packet data including the blue color display data and a blue color display reference gamma set. The sink device may receive the first through third packet data from the source device, may perform a digital-to-analog conversion for converting the red color display data included in the first packet data, the green color display data included in the second packet data, and the blue color display data included in the third packet data into red color display data voltages, green color display data voltages, and blue color display data voltages, and may display an image corresponding to the image frame using the red color display data voltages, the green color display data voltages, and the blue color display data voltages. The sink device may generate red color display gamma voltages for converting the red color display data included in the first packet data into the red color display data voltages using the red color display reference gamma set included in the first packet data, may generate green color display gamma voltages for converting the green color display data included in the second packet data into the green color display data voltages using the green color display reference gamma set included in the second packet data, and may generate blue color display gamma voltages for converting the blue color display data included in the third packet data into the blue color display data voltages using the blue color display reference gamma set included in the third packet data. Thus, the source device may individually control the red color display reference gamma set, the green color display reference gamma set, and the blue color display reference gamma set, and the sink device may individually generate and update the red color display gamma voltages, the green color display gamma voltages, and the blue color display gamma voltages based on the red color display reference gamma set, the green color display reference gamma set, and the blue color display reference gamma set that are received from the source device. As a result, the display system 1060 may substantially optimize (or improve) a quality of an image that is displayed by the sink device. Because these are described above, duplicated description related thereto may not be repeated.

The present inventive concept may be applied to a display system and an electronic device including the display system. For example, the present inventive concept may be applied to a cellular phone, a smart phone, a video phone, a smart pad, a smart watch, a tablet PC, a car navigation system, a television, a computer monitor, a laptop, a digital camera, a head mounted display device, or any other suitable display device as would be understood by those skilled in the art.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concepts. Accordingly, all such modifications are intended to be included within the scope of the present inventive concept as defined in the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display system comprising:

a source device configured to generate red color display data, green color display data, and blue color display data for implementing an image frame and to transmit first packet data comprising the red color display data and a red color display reference gamma set, second packet data comprising the green color display data and a green color display reference gamma set, and third packet data comprising the blue color display data and a blue color display reference gamma set; and a sink device configured to receive the first through third packet data from the source device, to perform a digital-analog conversion for converting the red color display data, the green color display data, and the blue color display data into red color display data voltages, green color display data voltages, and blue color display data voltages, respectively, and to display an image corresponding to the image frame using the red color display data voltages, the green color display data voltages, and the blue color display data voltages, wherein the sink device comprises:

a display panel configured to display the image;

a display panel driving circuit configured to drive the display panel; and a gamma voltage generating circuit configured to generate red color display gamma voltages, green color display gamma voltages, and blue color display gamma voltages for performing digital-to-analog conversion based on the red color display reference gamma set, the green color display reference gamma set, and the blue color display reference gamma set, respectively, wherein the source device is configured to perform a luminance clipping on the blue color display reference gamma set to improve blue color luminance linearity by limiting blue color maximum luminance.

2. The display system of claim 1, wherein the source device comprises a graphic processing unit, and the sink device comprises a display device.

3. The display system of claim 1, wherein the first through third packet data are universal serial interface (USI) packet data.

4. The display system of claim 1, wherein the gamma voltage generating circuit is implemented inside the display panel driving circuit.

5. The display system of claim 1, wherein the gamma voltage generating circuit comprises:

a gamma register configured to sequentially and temporarily store the red color display reference gamma set, the green color display reference gamma set, and the blue color display reference gamma set;

a gamma data generator configured to generate a red color display gamma set using a common reference gamma set and the red color display reference gamma set, to generate a green color display gamma set using the common reference gamma set and the green color display reference gamma set, and to generate a blue color display gamma set using the common reference gamma set and the blue color display reference gamma set; and a digital-to-analog converter configured to convert the red color display gamma set into the red color display gamma voltages, to convert the green color display gamma set into the green color display gamma voltages, and to convert the blue color display gamma set into the blue color display gamma voltages.

6. The display system of claim 5, wherein the gamma voltage generating circuit is configured to update the red color display gamma voltages, the green color display gamma voltages, and the blue color display gamma voltages for the image frame.

7. The display system of claim 5, wherein the gamma voltage generating circuit is configured to update the red color display gamma voltages, the green color display gamma voltages, and the blue color display gamma voltages when a gamma voltage update request signal is received from the source device.

8. The display system of claim 5, wherein the gamma register comprises a memory device having a capacity to store at least one selected from the red color display reference gamma set, the green color display reference gamma set, and the blue color display reference gamma set.

9. The display system of claim 1, wherein the gamma voltage generating circuit comprises:

a first gamma register configured to store the red color display reference gamma set;

a second gamma register configured to store the green color display reference gamma set;

a third gamma register configured to store the blue color display reference gamma set;

a gamma data generator configured to generate a red color display gamma set using a common reference gamma set and the red color display reference gamma set, to generate a green color display gamma set using the common reference gamma set and the green color display reference gamma set, and to generate a blue color display gamma set using the common reference gamma set and the blue color display reference gamma set; and a digital-to-analog converter configured to convert the red color display gamma set into the red color display gamma voltages, to convert the green color display gamma set into the green color display gamma voltages, and to convert the blue color display gamma set into the blue color display gamma voltages.

10. The display system of claim 9, wherein the gamma voltage generating circuit is configured to update the red color display gamma voltages, the green color display gamma voltages, and the blue color display gamma voltages for the image frame.

11. The display system of claim 9, wherein the gamma voltage generating circuit is configured to update the red color display gamma voltages, the green color display gamma voltages, and the blue color display gamma voltages when a gamma voltage update request signal is received from the source device.

12. The display system of claim 9, wherein the gamma voltage generating circuit is configured to update the red color display gamma voltages when a red color display reference gamma set of a current image frame is different from a red color display reference gamma set of a previous image frame, to update the green color display gamma voltages when a green color display reference gamma set of the current image frame is different from a green color display reference gamma set of the previous image frame, and to update the blue color display gamma voltages when a blue color display reference gamma set of the current image frame is different from a blue color display reference gamma set of the previous image frame.

13. The display system of claim 9, wherein the first gamma register comprises a first memory device having a capacity to store the red color display reference gamma set, the second gamma register comprises a second memory device having a capacity to store the green color display reference gamma set, and the third gamma register comprises a third memory device having a capacity to store the blue color display reference gamma set.

14. A method of generating gamma voltages, where the gamma voltages comprise red color display gamma voltages, green color display gamma voltages, and blue color display gamma voltages for converting red color display data, green color display data, and blue color display data into red color display data voltages, green color display data voltages, and blue color display data voltages, respectively, to implement image frames, the method comprising:

receiving first packet data comprising the red color display data and a red color display reference gamma set;

generating a red color display gamma set using a common reference gamma set and the red color display reference gamma set extracted from the first packet data;

converting the red color display gamma set into the red color display gamma voltages;

receiving second packet data comprising the green color display data and a green color display reference gamma set;

generating a green color display gamma set using the common reference gamma set and the green color display reference gamma set extracted from the second packet data;

converting the green color display gamma set into the green color display gamma voltages;

receiving third packet data comprising the blue color display data and a blue color display reference gamma set;

generating a blue color display gamma set using the common reference gamma set and the blue color display reference gamma set extracted from the third packet data; and converting the blue color display gamma set into the blue color display gamma voltages, wherein a luminance clipping is performed on the blue color display reference gamma set to improve blue color luminance linearity by limiting blue color maximum luminance.

15. The method of claim 14, wherein the first through third packet data are universal serial interface (USI) packet data.

16. The method of claim 14, wherein the red color display gamma voltages, the green color display gamma voltages, and the blue color display gamma voltages are updated for the image frame.

17. The method of claim 14, wherein the red color display gamma voltages, the green color display gamma voltages, and the blue color display gamma voltages are updated when a gamma voltage update request signal is received.

18. The method of claim 14, wherein the red color display gamma voltages are updated when a red color display reference gamma set of a current image frame is different from a red color display reference gamma set of a previous image frame, wherein the green color display gamma voltages are updated when a green color display reference gamma set of the current image frame is different from a green color display reference gamma set of the previous image frame, and wherein the blue color display gamma voltages are updated when a blue color display reference gamma set of the current image frame is different from a blue color display reference gamma set of the previous image frame.

* * * * *